United States Patent [19]

Bronson et al.

[11] Patent Number: 4,585,139

[45] Date of Patent: Apr. 29, 1986

[54] COOPERATING COVER MECHANISMS

[75] Inventors: Bruce A. Bronson, Anaheim; Anatoly Vanetik, Fullerton, both of Calif.

[73] Assignee: Sanders Associates, Inc., Nashua, N.H.

[21] Appl. No.: 763,491

[22] Filed: Aug. 8, 1985

[51] Int. Cl.[4] ..... B65D 79/00

[52] U.S. Cl. ..... 220/256; 220/1 T; 220/335; 206/305

[58] Field of Search ..... 220/256, 1 T, 1.5, 255, 220/260, 315, 334, 335, 346

[56] References Cited

U.S. PATENT DOCUMENTS

| | | | |
|---|---|---|---|
| 4,182,530 | 1/1980 | Hodge | 220/1 T X |
| 4,424,899 | 1/1984 | Rosenberg | 206/305 |
| 4,458,813 | 7/1984 | Tushinsky | 206/305 X |
| 4,513,877 | 4/1985 | Taguchi et al. | 220/335 |

*Primary Examiner*—Steven M. Pollard

*Attorney, Agent, or Firm*—Louis Etlinger; W. F. Porter, Jr.

[57] ABSTRACT

The housing (12) of a printer-plotter (10) includes a top cover (14) and a front cover (30) on adjoining housing walls. The top cover (14) is biased toward its open position by a gas spring (20) that is held closed by cooperating latch mechanisms on the top cover (14) and the front cover (30) in such a manner that the top cover (14) opens automatically when the front cover (30) is opened. When the top cover (14) is initially closed, a pivotable latch (22) on the top cover (14) engages a catch (24) on the housing (12) to hold the top cover (14) closed. When the front cover (30) is subsequently closed, a disengaging plate (48) causes the latch (22) to pivot out of engagement with the catch (24) and thus permit the top cover (14) to pivot slightly. However, a stop member (54) on the disengaging plate (48) prevents the top cover (14) from opening. Since the latch (22) no longer engages the catch (24), the top cover (14) automatically opens under the force of the gas spring (20) when the front cover (30) opens.

4 Claims, 3 Drawing Figures

COOPERATING COVER MECHANISMS

BACKGROUND OF THE INVENTION

The present invention relates to latching mechanisms for any type of enclosure in which two covers must be opened to permit adequate access to the closure interior. It is intended particularly for enclosures for printer-plotter devices, although its applicability clearly extends beyond such devices.

In some types of printer-plotters, access to the interior of the printer-plotter is obtained by opening covers on two adjoining surfaces. One of the covers typically is provided in a horizontal surface, and the horizontal cover is often heavy enough that a device providing a significant upward bias assists in opening the cover. A consequence of this arrangement often is that the user tends to use both hands to overcome the bias force when he closes the cover, but this can complicate the closing procedure in devices in which one closed cover keeps the other cover closed. An object of the present invention, therefore, is simple closing of such devices even when a relatively high force biases one of the covers open.

SUMMARY OF THE INVENTION

The foregoing and related objects are achieved in an enclosure assembly incorporating novel cooperating latch mechanisms on two adjoining covers on a housing. At least one of the covers is biased toward its open position, and the first cover has a pivotable latch that engages a catch on the housing when the first cover is fully closed. When the other, second, cover is brought from its open position to its closed position, a cam on the second cover engages the latch on the first cover to pivot it out of engagement with the catch. The first cover is thereby permitted to begin pivoting toward its open position. However, a stop member on the second cover stops the first cover in a position in which it is still substantially closed but in which its latch no longer engages the catch; that is, the first cover is in a state in which it is kept closed only by the stop member on the second cover. As a result, when the second cover is opened, the first cover opens automatically. Nonetheless, after closing the first cover, the user can leave it unattended in its closed position while he closes the second cover. He therefore does not need to hold the first cover in its closed position while he closes the second cover.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
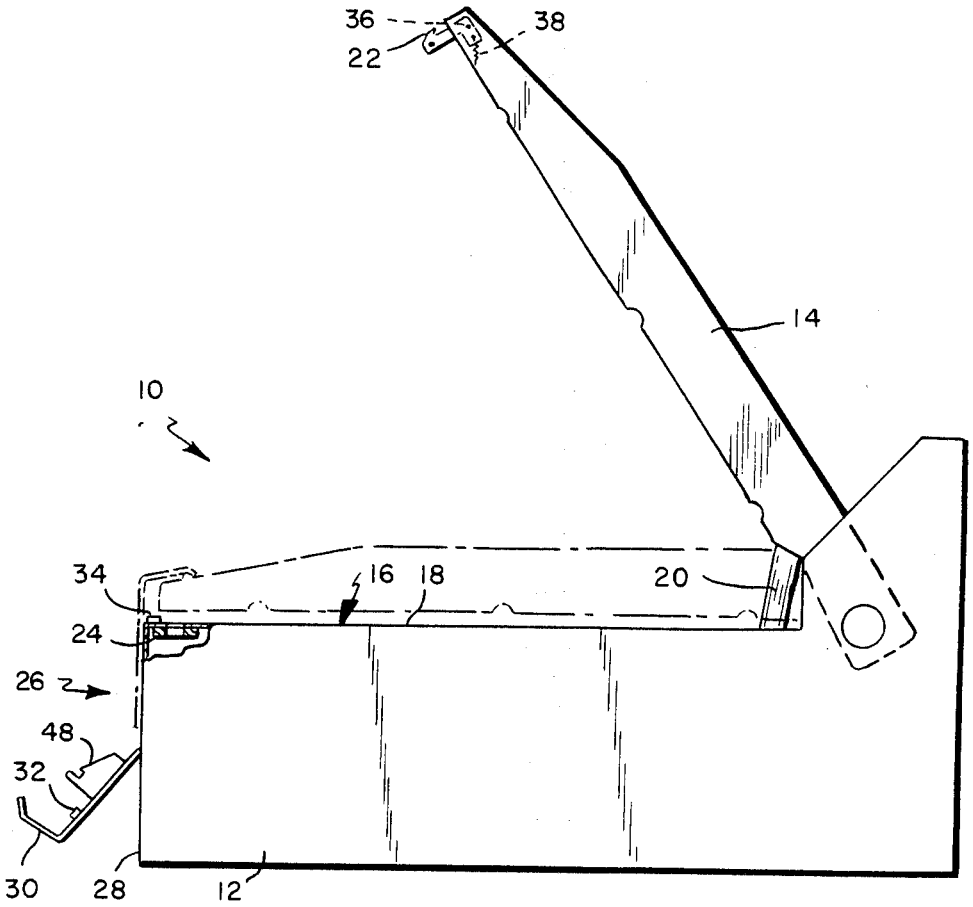
FIG. 1 is a simplified side sectional view of a printer-plotter having an enclosure incorporating the teachings of the present invention.

In FIG. 1, a printer-plotter 10 includes a housing 12 with a top cover 14 for closing an opening 16 in the upper wall 18. The top cover 14 is relatively heavy, so it is biased with an gas spring 20 to the open position shown in FIG. 1. A latch 22 provided on the front end of the cover 14 cooperates with a catch 24 on the housing 12 in a manner that will be described in more detail in connection with FIG. 2. A front opening 26 in the front wall 28 is closed by a front cover 30 when that cover is pivoted clockwise from the open position shown in solid lines in FIG. 1 to a closed position shown in phantom. When the front cover 30 is in its closed position, it is secured to the top cover 14 by a conventional latch and catch mechanism 32 and 34 whose details are not relevant to the present invention.

Figure 2:
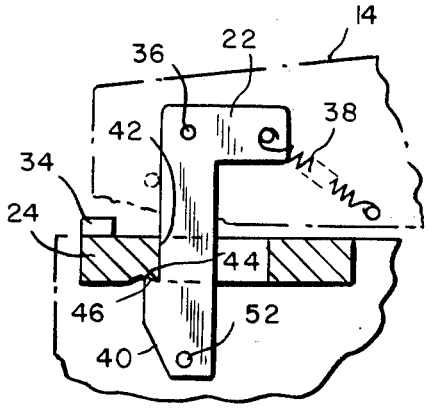
FIG. 2 is a detailed side sectional view of a portion of the enclosure showing a portion of the latch mechanism when the top cover, but not the side cover, is closed.

As FIG. 2 shows, the latch 22 is mounted on the top cover 14 by means of a pivot pin 36 and is biased clockwise by a spring 38 secured in tension between the pivotable latch 22 and the top cover 14. When the cover 14 is closed, a camming surface 40 on the lower end of the latch 22 engages an inner surface 42 (FIG. 2) of the catch 24, and the latch 22 is thus urged counterclockwise to permit further closure of the top cover 14. As the top cover 14 closes further, a notch surface 44 on the latch clears the lower end of the inner catch surface 42 to permit the pivotable latch 22 to pivot clockwise under the force applied by spring 38 so that the notch surface 44 on the latch 22 engages a mating notch 46 on the catch 24.

The top cover 14 is thus latched into its closed position, so the operator can attend to closing the front cover 30 without having to hold down the top cover 14. This is clearly desirable, since it is less awkward to close one cover if one is not required to hold the other cover down at the same time. It is particularly desirable in those printer-plotters in which the spring 20 biasing the top cover 14 toward its open position is fairly stiff and thus requires some users to exert significant effort if they are to hold the top cover 14 in its closed position with one hand.

Although the top cover 14 remains in its closed position without being held down while the user closes the front cover 30, it opens automatically under the force of spring 20 when the front cover 30 is opened. This results from the disengagement of the latch 22 from the catch 24 by a disengaging plate 48 provided on the front cover 30. The operation of the disengaging plate 48 is best understood by reference to FIG. 3, which shows that the disengaging plate 48 includes a cam surface 50. As the front cover 30 closes, cam surface 50 comes into contact with a cam post 52 on the latch 22 and urges it counterclockwise to bring the latch notch surface 44 out of engagement with the catch notch surface 46 and thus permit the top cover 14 to begin to pivot to its open position. As the top cover 14 pivots, the cam post 52 on the latch 22 rides up the cam surface 50 on the disengaging plate 48 until it reaches a stop member 54 provided on the disengaging plate 48. The stop member 54 stops the upward motion of the top cover 14 and permits the latch 22 to pivot clockwise slightly under the force of spring 38 so that the cam post 52 seats in a notch 56 in the disengaging plate 48. In this state, the front cover 30 is closed, and the top cover 14, although it has pivoted slightly towards its open position, remains essentially closed.

Figure 3:
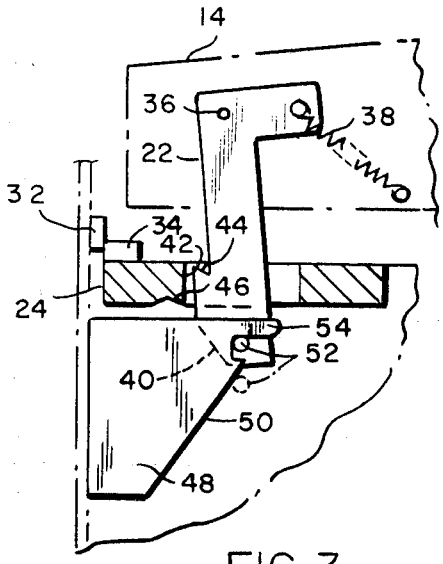
FIG. 3 is a similar view showing the latch mechanism with both covers closed.

Subsequently, when the user desires to gain access to the interior of the housing 12, he merely opens the front cover 30, which causes the stop member 54 to move to the left in FIG. 3 and thus release the cam post 52. Since the latch 22 was previously disengaged from the catch 24, the top cover 14 pivots under the force of the gas spring 20 to its completely open position.

In summary, access to the interior of the housing 12 is afforded by simply opening one of the covers, yet the housing 12 can be closed easily without holding both covers closed simultaneously. The mechanism of the present invention thus provides a particularly convenient means of opening and closing enclosures such as those that house printers and plotters.

We claim:

1. An enclosure comprising:

A. a housing generally defining a housing interior, including first and second substantially adjoining walls having first and second substantially adjoining apertures, respectively, opening into the housing interior;

B. a catch on the housing;

C. a first cover having pivot and free ends, the cover being pivotably mounted on the housing for pivoting, about a first pivot axis at its pivot end, between a fully closed position, in which it closes the first aperture, and an open position, in which it permits access to the housing interior through the first aperture, the first cover being biased toward its open position;

D. a latch pivotably mounted on the first cover, the latch being biased toward an engagement position in which, when the first cover is in its fully closed position, the latch engages the catch to prevent the first cover from pivoting toward its open position, pivoting of the latch from its engagement position disengaging it from the catch to permit the first cover to pivot toward its open position;

E. a second cover having pivot and free ends, the second cover being pivotably mounted on the housing for pivoting, about a second pivot axis at the pivot end of the second cover, between a fully closed position, in which it closes the second aperture, and an open position, in which it permits access to the housing interior through the second aperture;

F. a cam on the second cover having a cam surface positioned and angled for engagement of the latch to urge the latch out of its engagement position when the second cover is brought into its closed position and thereby to permit the first cover to pivot toward its open position; and G. a stop member provided on the second cover and positioned, when the second cover is in its closed position and the cam surface has urged the latch out of its engagement position and permitted the first cover to pivot toward its open position, to stop the first cover in a cocked position, in which it still substantially closes the first aperture but in which the latch cannot pivot back into engagement with the catch, whereby the first cover is permitted to open automatically when the first cover is opened.

2. An enclosure as defined in claim 1 further including a cover bias spring connected between the housing and the first cover to provide the bias of the first cover toward its open position.

3. An enclosure as defined in claim 2 wherein the cover bias spring comprises a gas spring.

4. An enclosure as defined in claim 1 in which the latch includes a cam post protruding therefrom and in which the cam and stop member together comprise a disengaging plate providing the cam surface disposed at an angle to the direction of motion of the first cover to engage the cam post to urge the latch out of its engagement position while the first cover pivots toward its open position, the disengagement plate providing the stop member as a tab having a stop surface adjacent to the cam surface and disposed substantially perpendicular to the direction of motion of the first cover to engage the cam post and stop it and thus the pivoting of the first cover after the cam post has reached the end of the cam surface.

* * * * *